US010536795B2

(12) United States Patent
MacLellan

(10) Patent No.: US 10,536,795 B2
(45) Date of Patent: Jan. 14, 2020

(54) VEHICLE AUDIO SYSTEM WITH REVERBERANT CONTENT PRESENTATION

(71) Applicant: Bose Corporation, Framingham, MA (US)

(72) Inventor: Donald Joseph MacLellan, Hudson, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/056,879

(22) Filed: Aug. 7, 2018

(65) Prior Publication Data

US 2019/0052992 A1 Feb. 14, 2019

Related U.S. Application Data

(60) Provisional application No. 62/543,422, filed on Aug. 10, 2017.

(51) Int. Cl.

| | |
|---|---|
| ***H04S 7/00*** | (2006.01) |
| ***H04R 5/04*** | (2006.01) |
| ***H04S 5/00*** | (2006.01) |
| *H04R 3/12* | (2006.01) |
| *H04R 5/02* | (2006.01) |

(52) U.S. Cl.

CPC ..... *H04S 7/305* (2013.01); *H04R 5/04* (2013.01); *H04S 5/005* (2013.01); *H04R 3/12* (2013.01); *H04R 5/02* (2013.01); *H04R 2205/024* (2013.01)

(58) Field of Classification Search

CPC combination set(s) only.

See application file for complete search history.

(56) References Cited

U.S. PATENT DOCUMENTS

| | | | | |
|---|---|---|---|---|
| 4,819,269 | A * | 4/1989 | Klayman | H04S 3/00 381/302 |
| 5,699,438 | A | 12/1997 | Smith et al. | |
| 5,724,429 | A * | 3/1998 | Banerjea | H04S 1/002 381/1 |
| 5,754,664 | A | 5/1998 | Clark et al. | |
| 5,920,039 | A | 7/1999 | Cote et al. | |
| 6,324,294 | B1 | 11/2001 | Azima et al. | |
| 6,356,641 | B1 | 3/2002 | Warnaka et al. | |

(Continued)

FOREIGN PATENT DOCUMENTS

| | | |
|---|---|---|
| CN | 105443286 A | 3/2016 |
| DE | 19654416 C1 | 5/1998 |

(Continued)

OTHER PUBLICATIONS

Continental, "Acts like a violin: Continental presents innovative car audio technology," https://www.continental-corporation.com/en/press/press-releases, Jun. 28, 2017, 4 pages.

(Continued)

*Primary Examiner* — Duc Nguyen
*Assistant Examiner* — Assad Mohammed
(74) *Attorney, Agent, or Firm* — Hoffman Warnick LLC

(57) ABSTRACT

Various implementations include vehicle audio systems and related control methods. In some particular implementations, an audio system is configured to present audio content to a vehicle occupant to modify the perceived size of the vehicle cabin relative to its actual physical size.

14 Claims, 4 Drawing Sheets

(56) References Cited

U.S. PATENT DOCUMENTS

| | | | | |
|---|---|---|---|---|
| 6,377,695 | B1 | 4/2002 | Azima et al. | |
| 6,555,042 | B1 | 4/2003 | Mola et al. | |
| 7,050,593 | B1 | 5/2006 | Emerling et al. | |
| 7,218,745 | B2 | 5/2007 | McConnell et al. | |
| 7,259,504 | B2 | 8/2007 | Schurz et al. | |
| 8,170,265 | B2 | 5/2012 | Hagedorn-Millard et al. | |
| 9,085,273 | B2 | 7/2015 | Smykalla | |
| 9,277,342 | B2 | 3/2016 | Lukasczyk et al. | |
| 2001/0012369 | A1* | 8/2001 | Marquiss | H04R 5/02 381/86 |
| 2002/0133327 | A1* | 9/2002 | McGrath | H04R 5/04 703/21 |
| 2003/0108210 | A1 | 6/2003 | Dreyer et al. | |
| 2004/0237111 | A1* | 11/2004 | Iraclianos | B60K 35/00 725/75 |
| 2007/0121955 | A1* | 5/2007 | Johnston | H04S 7/301 381/56 |
| 2008/0072670 | A1 | 3/2008 | Brandmeier et al. | |
| 2009/0060208 | A1* | 3/2009 | Pan | H04S 7/30 381/17 |
| 2010/0303245 | A1* | 12/2010 | Vickers | H04S 1/005 381/17 |
| 2014/0161276 | A1* | 6/2014 | Klier | G10K 15/02 381/86 |
| 2014/0270216 | A1* | 9/2014 | Tsilfidis | H04M 9/082 381/66 |
| 2014/0334637 | A1 | 11/2014 | Oswald et al. | |
| 2015/0256933 | A1 | 9/2015 | Vautin et al. | |
| 2015/0350801 | A1* | 12/2015 | Koppens | H04S 1/005 381/1 |
| 2016/0084186 | A1 | 3/2016 | Collet et al. | |
| 2019/0042647 | A1* | 2/2019 | Oh | G06F 16/637 |

FOREIGN PATENT DOCUMENTS

| | | | |
|---|---|---|---|
| DE | 10361393 | B3 | 8/2005 |
| DE | 102008017067 | A1 | 10/2009 |
| DE | 102008039164 | A1 | 2/2010 |
| DE | 102009042781 | A1 | 3/2011 |
| DE | 102014214299 | B3 | 1/2016 |
| DE | 102015205042 | A1 | 9/2016 |
| FR | 2983655 | A1 | 6/2013 |
| KR | 101172882 | B1 | 8/2012 |
| WO | 2009029471 | A1 | 3/2009 |
| WO | 2010006924 | A1 | 1/2010 |
| WO | 2012172394 | A1 | 12/2012 |
| WO | 2016055569 | A1 | 4/2016 |
| WO | 2017182377 | A1 | 10/2017 |

OTHER PUBLICATIONS

Stereophile Staff, "Harman Signs License Agreements with New Transducers Limited," htttps:www.stereophile.com/news, Feb. 22, 1998, 5 pages.

International Search Report and Written Opinion for International Application No. PCT/US2018/045549, dated Oct. 31, 2018, 14 pages.

* cited by examiner

VEHICLE AUDIO SYSTEM WITH REVERBERANT CONTENT PRESENTATION

CROSS-REFERENCE TO RELATED APPLICATION

This application claims priority to U.S. Provisional Application No. 62/543,422, filed on Aug. 10, 2017, which is hereby incorporated by reference in its entirety.

TECHNICAL FIELD

This disclosure generally relates to vehicle audio systems. More particularly, the disclosure relates to approaches and related systems for presenting reverberant audio content in a vehicle.

BACKGROUND

In some vehicle (e.g., automobile) audio systems, processing is applied to the audio signals provided to each speaker based on the electrical and acoustic response of the total system, that is, the responses of the speakers themselves and the response of the vehicle cabin to the sounds produced by the speakers. Such a system is highly individualized to a particular vehicle model and trim level, taking into account the location of each speaker and the absorptive and reflective properties of the seats, glass, and other components of the car, among other things. Such a system is generally designed as part of the product development process of the vehicle and corresponding equalization and other audio system parameters are loaded into the audio system at the time of manufacture or assembly.

However, conventional vehicle audio systems can fail to provide an immersive audio experience for the vehicle occupants. The confined space of the vehicle cabin can create "dead" sound, diminishing the perceived quality of the audio from the system.

SUMMARY

All examples and features mentioned below can be combined in any technically possible way.

Various implementations include vehicle audio systems and related control methods. In some particular implementations, an audio system is configured to present audio content to a vehicle occupant to modify the perceived size of the vehicle cabin relative to its actual physical size.

Some particular aspects include an audio system for a vehicle, the audio system having: a plurality of speakers located in the vehicle; at least one transducer affixed to an overhead structure of the vehicle; and an amplifier connected with the plurality of speakers and the at least one transducer, the amplifier having circuitry configured to process entertainment audio signals to generate spatially enhanced entertainment audio content that is provided to the plurality of speakers for output, and reverberant content that is provided to the at least one transducer for output, where presentation of both the spatially enhanced entertainment audio content and the reverberant content within a cabin of the vehicle causes an occupant of the vehicle to have a first auditory perception of a size of the cabin, while presentation of only the spatially enhanced entertainment audio content within the cabin causes the occupant to have a second, different auditory perception of the size of the cabin.

Additional particular aspects include a computer-implemented method of controlling an audio system in a vehicle.

The audio system includes: a plurality of speakers located in the vehicle; at least one transducer affixed to an overhead structure of the vehicle; and an amplifier connected with the plurality of speakers and the at least one transducer. The computer-implemented method includes: receiving entertainment audio signals from an external source; and from the entertainment audio signals, generating spatially enhanced entertainment audio content for output at the plurality of speakers, and generating reverberant content for output at the at least one transducer, where presentation of both the spatially enhanced entertainment audio content and the reverberant content within a cabin of the vehicle causes an occupant of the vehicle to have a first auditory perception of a size of the cabin while presentation of only the spatially enhanced entertainment audio content within the cabin causes the occupant to have a second, different auditory perception of the size of the cabin.

Implementations may include one of the following features, or any combination thereof.

In certain aspects, the first auditory perception of the size of the cabin is larger than the second auditory perception of the size of the cabin.

In particular cases, the overhead structure includes a headliner of the vehicle, and the plurality of speakers are located in regions of the vehicle other than the headliner.

In some implementations, the at least one transducer includes an exciter.

In certain cases, the at least one transducer includes a speaker distinct from the plurality of speakers.

In particular aspects, the circuitry in the amplifier includes first circuitry for applying spatial enhancement processing to the entertainment audio signals to generate the spatially enhanced entertainment audio content. In some implementations, the circuitry further includes second circuitry for applying reverberant signal processing to the entertainment audio signals to generate the reverberant content.

In particular aspects, the at least one transducer is affixed to the overhead structure of the vehicle at a location behind a front seat of the vehicle.

In certain implementations, the at least one transducer includes a plurality of transducers configured to operate as a unit.

In some aspects, the at least one transducer includes a first transducer affixed to the overhead structure at a location directly above or in front of a front seat of the vehicle, and a second transducer affixed to the overhead structure at a location behind the front seat of the vehicle. In particular cases, the circuitry is further configured to apply a first gain to a reverb signal provided to the first transducer and apply a second (and potentially distinct) gain to a reverb signal provided to the second transducer, where the second gain is equal to or greater than the first gain. In certain implementations, the second transducer is one of a plurality of transducers configured to operate as a unit.

In some aspects, the reverberant content is configured to simulate a time domain response and a frequency domain response of a small room having a short reverberation time. In particular cases, the short reverberation time is less than or equal to two seconds. In certain implementations, the small room has physical dimensions that are larger than physical dimensions of the cabin of the vehicle.

In some cases, the system further includes a user interface connected with the amplifier, the user interface having a plurality of user-selectable settings for controlling the first auditory perception of the size of the cabin.

In particular aspects, the amplifier is further configured to: detect uncorrelated information in the entertainment audio signals; and in response to failing to detect any uncorrelated information in the entertainment audio signals, disabling the generating of the reverberant content provided to the at least one transducer for output.

In certain implementations, the first auditory perception of the size of the cabin is larger than the second auditory perception of the size of the cabin, where the reverberant content is configured to simulate a time domain response and a frequency domain response of a small room having a short reverberation time, where the short reverberation time is less than or equal to two seconds.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
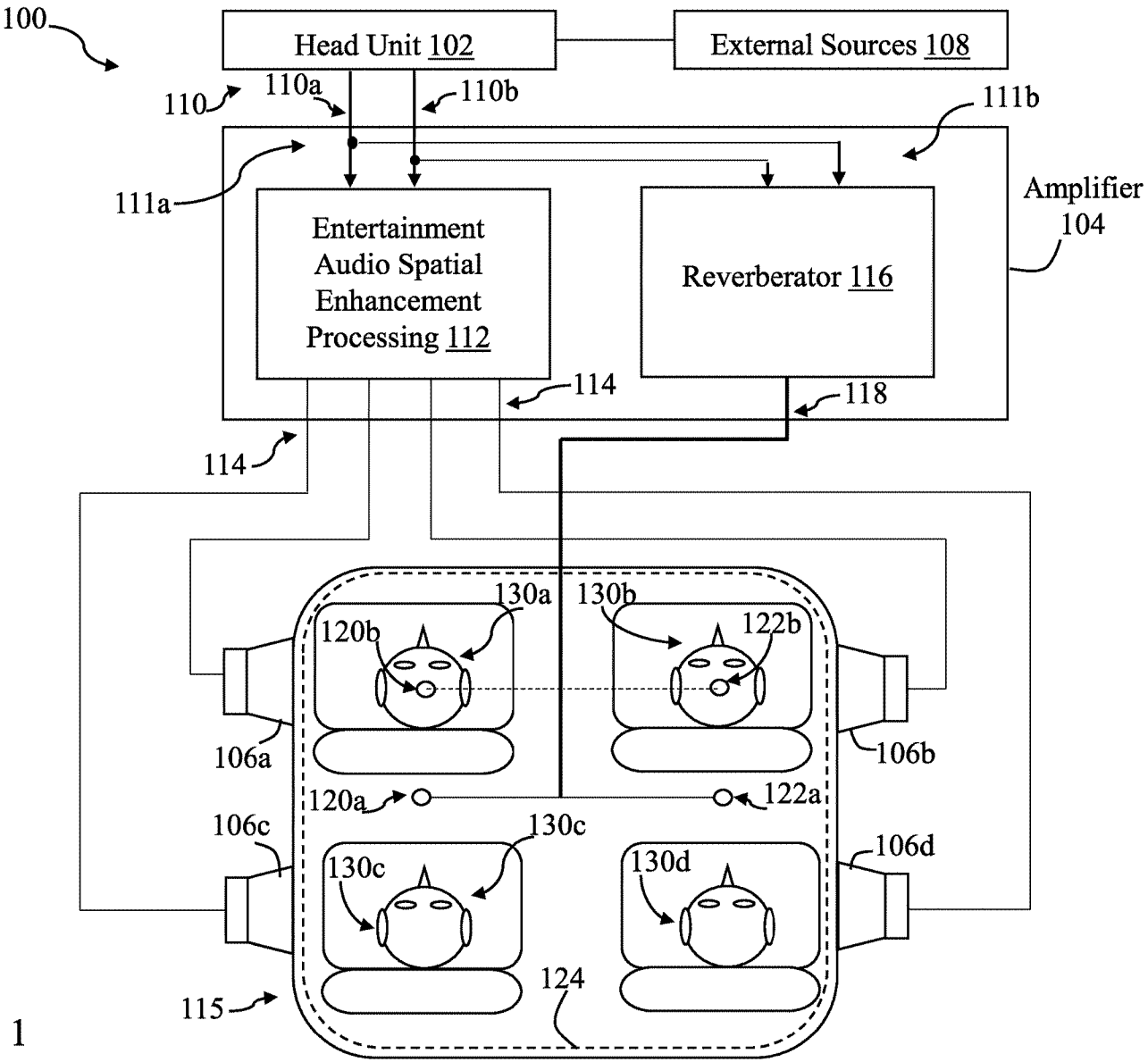
FIG. 1 is a schematic depiction of an audio system in an automobile according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a control system and transducer configuration can be beneficially incorporated into a vehicle audio system. For example, a vehicle audio system can be configured with at least one overhead transducer and be programmatically controllable to provide reverberant audio content. The system and related method can significantly improve the user experience when compared with conventional vehicle audio systems.

Commonly labeled components in the FIGURES are considered to be substantially equivalent components for the purposes of illustration, and redundant discussion of those components is omitted for clarity.

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Operations may be performed by analog circuitry or by a microprocessor executing software that performs the mathematical or logical equivalent to the analog operation. Unless otherwise indicated, signal lines may be implemented as discrete analog or digital signal lines, as a single discrete digital signal line with appropriate signal processing to process separate streams of audio signals, or as elements of a wireless communication system. Some of the processes may be described in block diagrams. The activities that are performed in each block may be performed by one element or by a plurality of elements, and may be separated in time. The elements that perform the activities of a block may be physically separated. Unless otherwise indicated, audio signals or video signals or both may be encoded and transmitted in either digital or analog form; conventional digital-to-analog or analog-to-digital converters may not be shown in the figures.

Conventional vehicle audio systems are based around a set of four or more speakers, two on the instrument panel or in the front doors and two generally located on the rear package shelf, in sedans and coupes, or in the rear doors or walls in wagons and hatchbacks. The example vehicle audio system 100 shown in FIG. 1 depicts a wagon or hatchback configuration including a speaker on each of the four doors. It is understood that this configuration is only one example of an audio system used to illustrate various implementations of the disclosure, and that a variety of additional configurations can be utilized with these implementations.

Turning specifically to FIG. 1, vehicle audio system 100 is shown including a head unit 102, an amplifier 104, and four speakers 106*a-d*. The head unit 102 provides a user (also referred to as "occupant") with AM/FM tuning, audio source selection, and media (e.g., digital media and/or CD) playback capability. The head unit 102 is also able to receive signals from external sources 108, such as digital music players (e.g., mp3, CD, DVD music players), portable navigation device(s), a satellite radio receiver, cellular telephones, cloud-based music sources and/or other sources.

The head unit 102 provides an entertainment audio signal 110 to the amplifier 104. As used herein, "entertainment audio", "entertainment audio signals", and similar terms can refer to any audio signal conventionally provided for playback in a vehicle audio system. For example, entertainment audio signal(s) 110 can include radio transmissions, streaming audio signals, and/or recorded, downloaded, or otherwise accessible audio signals. These signals can include music, talk shows, podcasts, audio books, etc., and can be accessible from any sources described herein.

In FIG. 1, the entertainment audio signal 110 is depicted as a two-channel (left channel signal 110*a* and right channel signal 110*b*) stereo signal. The amplifier 104 includes circuitry (not shown) for splitting (or, "processing") the entertainment audio signal 110 into two stereo pairs, and providing each stereo pair to a respective one of two signal processing paths 111*a,b* for parallel processing. This processing can be performed using a demultiplexer (or demux), which is configured to direct the same signal to multiple locations (e.g., multiple circuits).

The amplifier 104 can include one or more combined source/processing/amplifying units. In some examples, the different functions may be divided between multiple components. In particular, the source is often separated from the amplifier, and the processing is provided by either the source or the amplifier, though the processing may also be provided by a separate component. The processing may also be provided by software loaded onto a general purpose computer providing functions of the source and/or the amplifier. We refer to signal processing and amplification provided by "the system" or "circuitry" generally, without specifying any particular system architecture or technology.

Additionally, the amplifier 104 can include a control system including hardware and/or software for controlling signal processing and additional functions described herein.

It is further understood that one or more aspects of the amplifier 104, including the control system (and its corresponding functions) can be implemented using one or more remote computing devices (e.g., cloud computing devices) which are programmatically linked with the amplifier 104. As noted herein, the amplifier 104 can include any software-based, electrical and/or electro-mechanical control configuration capable of receiving control instructions (e.g., via an interface or other communication protocol) and adjusting presentation of audio content to a listener.

The first signal processing path 111*a* includes circuitry 112 for applying a conventional spatial enhancement processing to the entertainment audio signal 110 to enhance the presentation of entertainment audio inside a passenger cabin 115 of the vehicle. Spatial enhancement can include adding channels, such as center or surround channels, or other processing that can affect the spatial characteristics of the audio system 100. The circuitry (also referred to as, entertainment audio spatial enhancement processing circuitry) 112 generates signals, referred to herein as "spatially enhanced entertainment audio signals 114" (which can also include spectral enhancement) that are directed to the associated speakers 106*a-d*, which, when outputted, define amongst other things, a front stage. As noted herein, this spatial enhancement processing can be performed using conventional techniques and circuitry, including equalization, delay and/or phase adjustments.

The second signal processing path 111*b* includes a reverberator 116 for applying a reverberation signal processing algorithm to the entertainment audio signal 110 to create a reverb effect. In some implementations, the reverberator 116 includes circuitry that is configured to simulate the time domain response and frequency domain response of a small room, that is, a room with a short $RT_{60}$ (e.g., two (2) seconds or less for the sound to die down completely in some cases, or as little as one (1) second or less in certain cases) and is defined by a combination of room parameters, including size, shape, and type of materials that line the walls. In one example, the small room parameters are defined by a room width of 30 feet (ft), a room length of 50 ft, and a room height of 14 ft. In other example implementations, the small room parameters are defined by a room of approximately 5,000-8,000 cubic ft. In some particular examples, the small room parameters can approximate a room of approximately 6,400 cubic ft. (+/−several hundred cubic ft.). In certain example implementations, the small room parameters represent a room having a diffuse nature, with non-parallel walls and a ceiling with a plurality of angled surfaces. The room represented by these parameters reflects sound in all directions with little or no acoustic absorption.

In any case, the parameters (e.g., physical dimensions) of the small room are larger than the parameters (e.g., physical dimension) of the vehicle cabin 115. The output of the reverberator 116 includes reverberant content in the form of a reverberation signal that is referred to herein as a "reverb signal 118." In some implementations, the reverb signal 118 is a mono signal.

In the example of FIG. 1, the reverb signal 118 is equalized and amplified by circuitry in the amplifier 104 (circuitry not shown) prior to being directed to at least one transducer affixed to an overhead structure of the vehicle. In the example depicted in FIG. 1, two transducers 120*a*, 122*a* are shown as directly affixed to an overhead structure of the vehicle (e.g., inside of a headliner 124 of the vehicle, illustrated in phantom). In various implementations, the transducers 120*a*, 122*a* can include one or more speakers (e.g., similar to speakers 106). However, in additional implementations, transducers 120*a*, 122*a* can include one or more exciters. Additional transducers (visually depicted in FIG. 1 by the dotted lined circles 120*b*, 122*b*) can also be directly affixed to the vehicle headliner, e.g., in a position directly above the intended seating location of a vehicle occupant. Each transducer in the second signal processing path 111*b* is configured to equalize the reverb signal 118 to account for frequency response of the vehicle cabin 114 as well as the frequency response of the corresponding speaker and headliner 124 combination.

In the case where the transducers 120, 122 include exciters, each exciter 120*a*, 120*b*, 122*a*, 122*b* has a voice coil, a suspension system, electrical connection terminals, and a coupling plate or ring that joins the voice coil to a mounting surface, in this case, the headliner 124. In these implementations, each exciter 120*a*, 120*b*, 122*a*, 122*b* uses the movement of itself to apply force from the voice coil to the headliner, the vibration of which produces an overhead sound. In other words, the headliner of the vehicle functions as a radiating surface.

In the case where the transducers 120, 122 include speakers, the speaker in each transducer 120*a*, 120*b*, 122*a*, 122*b* can include a tweeter and a low-to-mid range speaker element. In another arrangement, the smaller speaker is a mid-to-high frequency speaker element and the larger speaker is a woofer, or low-frequency speaker element. The two or more elements may be combined into a single enclosure or may be installed separately. The speaker elements in each set may be driven by a single amplified signal from the amplifier 104, with a passive crossover network (which may be embedded in one or both speakers) distributing signals in different frequency ranges to the appropriate speaker elements. Alternatively, the amplifier 104 may provide a band-limited signal directly to each speaker element. In other examples, full range speakers are used, and in still other examples, more than two speakers are used per set. Each individual speaker shown may also be implemented as an array of speakers, which may allow more sophisticated shaping of the sound, or simply a more economical use of space and materials to deliver a given sound pressure level.

In still further implementations, at least one of the transducers 120*a*, 120*b*, 122*a*, 122*b* is a speaker, while at least one of the other transducers is an exciter. In some cases, the transducers 120*a*, 120*b*, 122*a*, 122*b* can be configured as an array, so that the radiation pattern from the transducers can be controlled and/or adjusted to direct sound in a particular direction (e.g., side and/or forward directions).

The combination of the presentation of the spatially enhanced entertainment audio signals 114 and the presentation of the reverb signal 118 gives an occupant (e.g., any of occupants 130*a-d*) of the vehicle the impression of being in a space that is slightly larger than (i.e., higher, wider, and deeper rearward or some combination thereof) the vehicle cabin 115 without pulling the forward image inward (i.e., toward the occupant(s) 130*a-d*).

The small room parameters for the reverberator 116 can be carefully selected to provide an audio presentation experience of being in a slightly larger space than the interior of the vehicle cabin 115. The size of the small room can be chosen so that the listening experience is realistic and believable to the vehicle occupant 130 relative to the visual cues of being inside the vehicle cabin 115.

In some implementations, two transducers (e.g., two exciters or two speakers) 120*a*, 122*a* are located (and affixed to the vehicle's overhead structure) behind the occupants of the front seats, one in a driver's half of the vehicle cabin 115 and another in a front seat passenger's half of the vehicle cabin 115. The use of two transducers (e.g., two exciters or two speakers) 120*a*, 122*a* rather than a single transducer affixed to the headliner provides a presentation that has a greater sense of height without forward localization. That is, while the configuration and tuning of the audio system 100 (including the entertainment audio spatial enhancement processing 112) create the forward image, the reverberator 116 and transducers 120*a*, 122*a* create the sense of height and space without affecting that forward image.

In other implementations, the vehicle audio system 100 has two pairs of transducers (e.g., two pairs of exciters, or two pairs of speakers), including a first transducer pair (e.g., a pair of exciters, or a pair of speakers) 120*a*, 120*b* affixed to the overhead structure in the driver's half of the vehicle cabin 115 and a second transducer pair (e.g., a pair of exciters, or a pair of speakers) 122*a*, 122*b* affixed to the overhead structure in the front seat passenger's half of the vehicle cabin 115. Each transducer pair includes a transducer ("rear transducer 120*a*, 122*a*") that is located behind the intended seating position of a listener (e.g., intended occupant 130*a* or 130*b*) and a transducer ("overhead transducer 120*b*, 122*b*") that is located directly above an intended seating position of the listener. In these particular implementations, the gain of the reverb signal 118 that is sent to each overhead transducer 120*b*, 122*b* is equal to or less than the gain of the reverb signal 118 that is sent to each rear transducer 120*a*, 122*a* to raise the perceived ceiling of the vehicle cabin without pulling the image forward. In more particular cases, the gain of the reverb signal 118 that is sent to each overhead transducer 120*b*, 122*b* is less than the gain of the reverb signal 118 that is sent to each rear transducer 120*a*, 122*a*.

Figure 2:
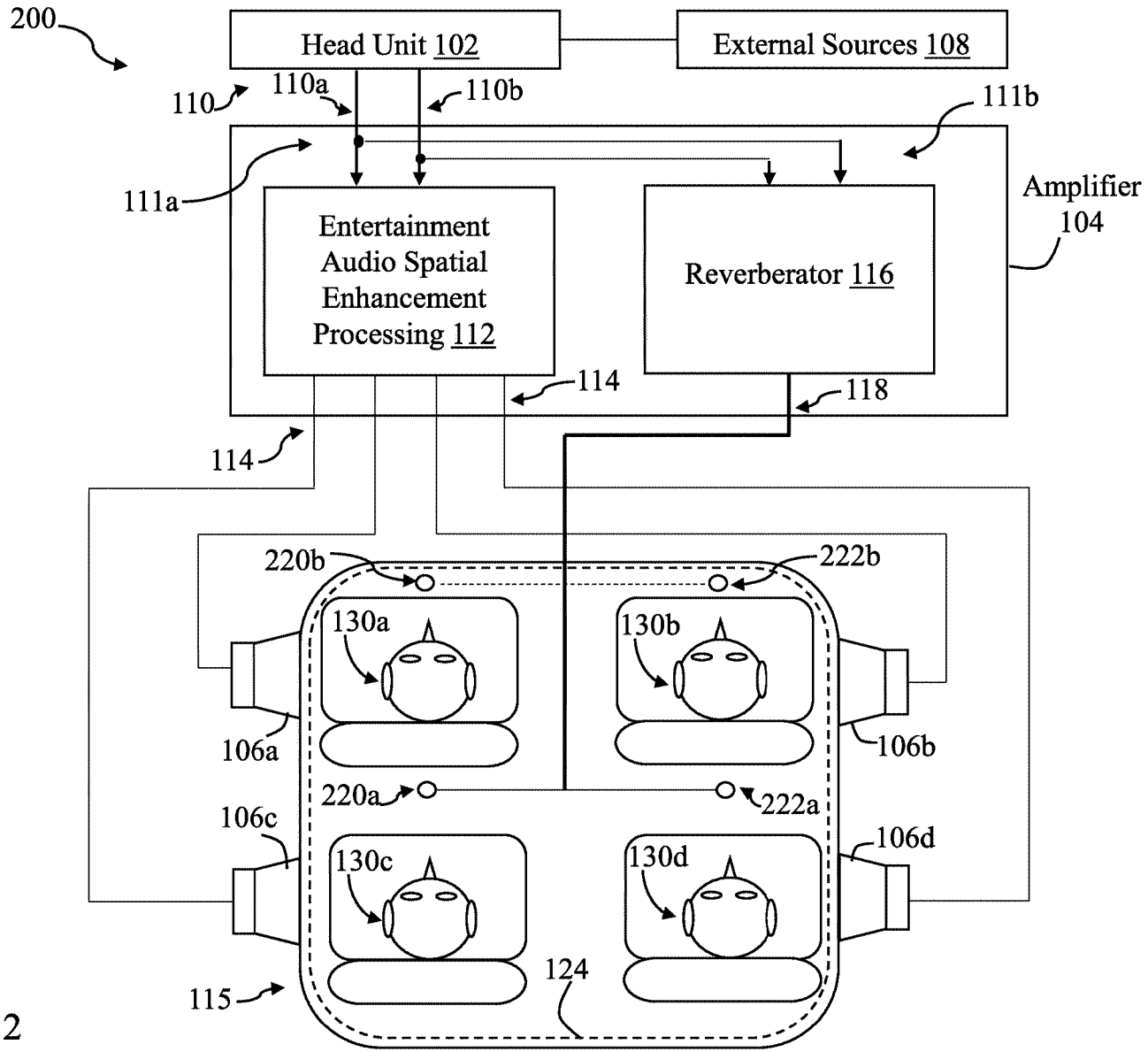
FIG. 2 is a schematic depiction of an audio system in an automobile according to various additional implementations.

FIG. 2 depicts an additional implementation of a vehicle audio system 200 having two pairs of transducers affixed to the overhead structure in the vehicle cabin 115. In these implementations, the vehicle audio system 200 has two pairs of transducers (e.g., two exciters or two speakers), including a first transducer pair in a driver's half of the vehicle cabin 115 and a second transducer pair in a front seat passenger's half of the vehicle cabin 115. Each transducer pair includes a rear transducer 220*a*, 222*a* that is located behind the intended seating position of a listener (e.g., intended occupant 130*a* or 130*b*) and a front transducer 220*b*, 222*b* that is located forward of an intended seating position of the listener. In certain implementations, the gain of the reverb signal 118 that is sent to the front transducers 220*b*, 222*b* is different from the gain of the reverb signal 118 that is sent to the rear transducers 220*a*, 222*a*.

Figure 3:
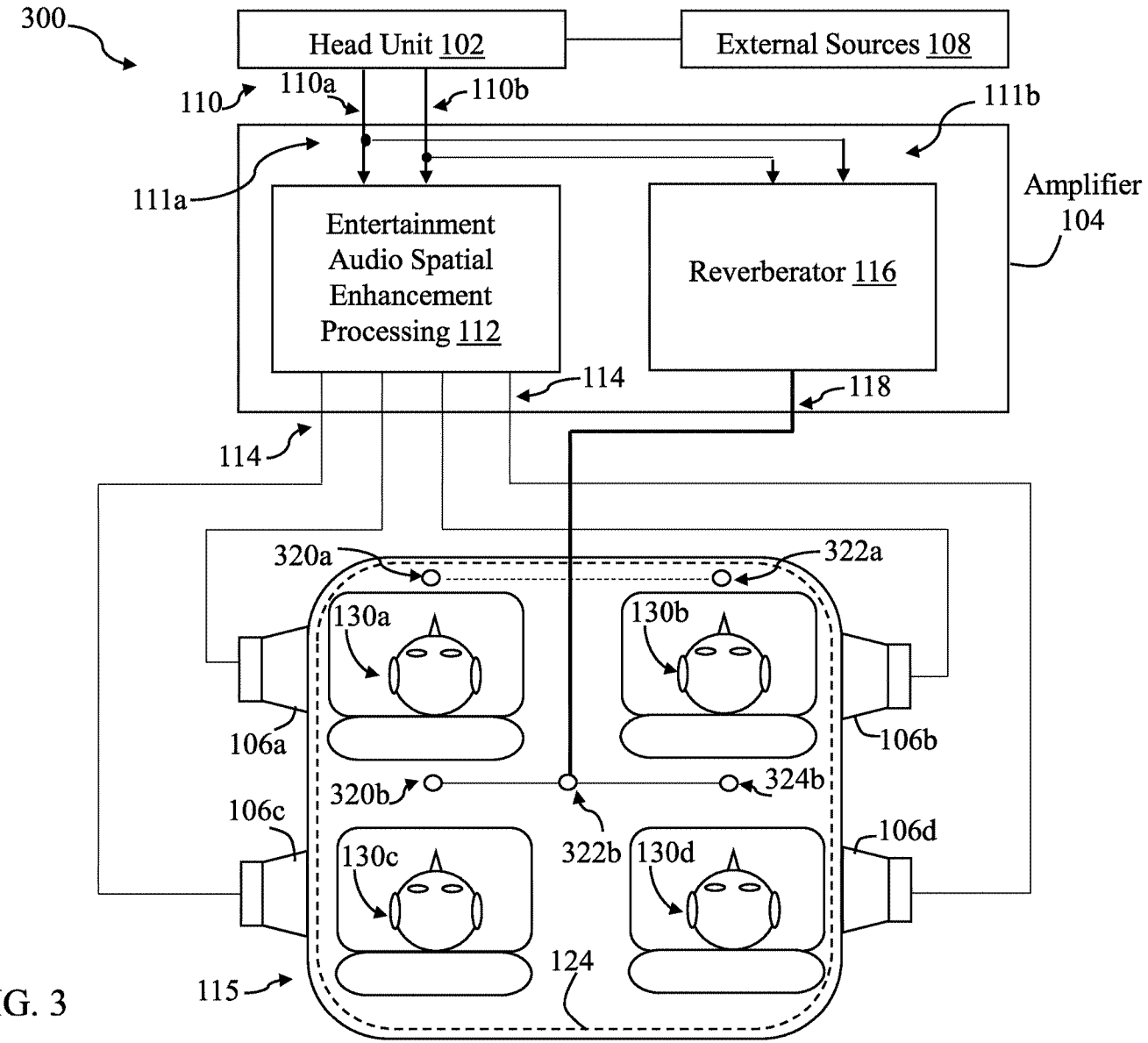
FIG. 3 is a schematic depiction of an audio system in an automobile according to various further implementations.

FIG. 3 depicts an additional implementation of a vehicle audio system 300 having two front transducers (e.g., two exciters or two speakers), and a network of rear transducers (e.g., a network of exciters and/or speakers), all affixed to the overhead structure in the vehicle cabin 115. Each front speaker 320*a*, 322*a* is located forward of a respective intended seating position of a listener in a front seat of the vehicle. The network of rear transducers 320*b*, 322*b*, 324*b*, etc. is formed by multiple speakers that are grouped together to operate as a unit. While three rear transducers 320*b*, 322*b*, 324*b* are shown in this example implementation, any number of transducers greater than two can form the network of rear transducers. In one example, the network of rear transducers is centered along the length of the headliner and located just behind the front seats of the vehicle. In another example, the network of rear transducers 320*b*, 322*b*, 324*b*, etc. is centered along the length of the headliner and located close to the rear window of the vehicle. In certain cases, the gain of the reverb signal 118 that is sent to the front transducers 320*a*, 322*a* is different from the gain of the reverb signal 118 that is sent to the network rear transducers 320*b*, 322*b*, 324*b*, etc.

It is understood that the network of rear transducers can include a mix of exciters and speakers in particular implementations, e.g., in order to change the radiation pattern of the transducers. For example, using a mix of exciters and speakers in the network of rear transducers could help to direct the sound from the audio system 300 forward or to the sides.

The audio systems (e.g., audio systems 100, 200, and 300) disclosed according to various implementations are configured to present spatially enhanced entertainment audio content and reverberant content within the cabin 115 of the vehicle to adjust the perceived size of the cabin 115 from an auditory perspective. For example, in one case, the audio systems can present both spatially enhanced entertainment audio content and reverberant content within the cabin 115, which causes the occupant 130*a-d* to have a first auditory perception of a size of the cabin. In another case, the audio systems can present only the spatially enhanced entertainment audio content within the cabin, which cause the occupant 130*a-d* to have a second, different auditory perception of the size of the cabin. In these scenarios, presenting both the spatially enhanced entertainment audio content and the reverberant content causes the occupant to perceive the size of the cabin as being larger than when the spatially enhanced entertainment audio content is presented without the reverberant content. In particular cases, utilizing exciters in particular locations can reduce costs relative to speakers, even though in these cases exciters may be less localizable than speakers.

With continuing reference to FIGS. 1-3, in additional implementations, the amplifier 104 can be configured to perform additional processes. For example, amplifier 104 can be configured to dynamically adjust the use of reverberant content based upon detected characteristics of the entertainment audio signals 110. As noted herein, the amplifier 104 is configured to detect uncorrelated information in the entertainment audio signals 110, and in response to detecting that uncorrelated information, generates the reverberant content for output at the transducer(s) (e.g., transducers 120*a*, 122*a*).

This uncorrelated information can represent the acoustic response of the environment in which a recording takes place, and/or can represent sound coming from several sources which are unrelated. For example, uncorrelated information (or uncorrelated sound) may come from two different sources (e.g., instruments or singers), or from the same source but with a significant delay due to reflections from the environment in which the audio was recorded. In the first instance, different sources will generate different waveforms and at different frequencies. In the second instance, although the additional sound comes from the primary source, the delay will change the waveform of that sound such that the two sounds are no longer correlated (e.g., changed in pitch, amplitude and waveshape). While many entertainment audio signals will include uncorrelated information, some audio content is recorded in environments in order to remove environmental sound (e.g., room sound), and does not include uncorrelated information. For example, recording an announcer in a recording booth may not produce any uncorrelated information, as the size of the booth prevents significant signal delay to the microphone(s) between the direct and reflected sound. In these cases, the entertainment audio signals 110 will not include any uncorrelated information. Presenting reverberant content in these scenarios will cause the listener to perceive, e.g., an announcer to sound as though she is in a larger room (not a recording booth).

In still other implementations, the amplifier 104 (e.g., reverberator 116, FIG. 1) can be configured to detect characteristics of the entertainment audio signals 110 to apply different levels of reverberation to those signals. While the reverberator 116 can store a predefined number of reverberation settings, the reverberation setting for a particular incoming entertainment audio signal 110 can be calculated and implemented in real-time or near real-time. For example, in some cases, the amplifier 104 can include a machine learning engine, which may include an artificial neural network (ANN) or other artificial intelligence component configured to enhance the ability of audio system 100 to adjust the reverberation setting for the entertainment audio signals 110 based upon one or more characteristics of those signals.

Additionally, the machine learning engine can be used to update stored characteristic/filter/setting correlations in order to enhance the ability of audio system(s) 100 (e.g., audio system 100, 200, 300) to adjust the reverberation settings based upon the incoming entertainment audio signals 110.

Figure 4:
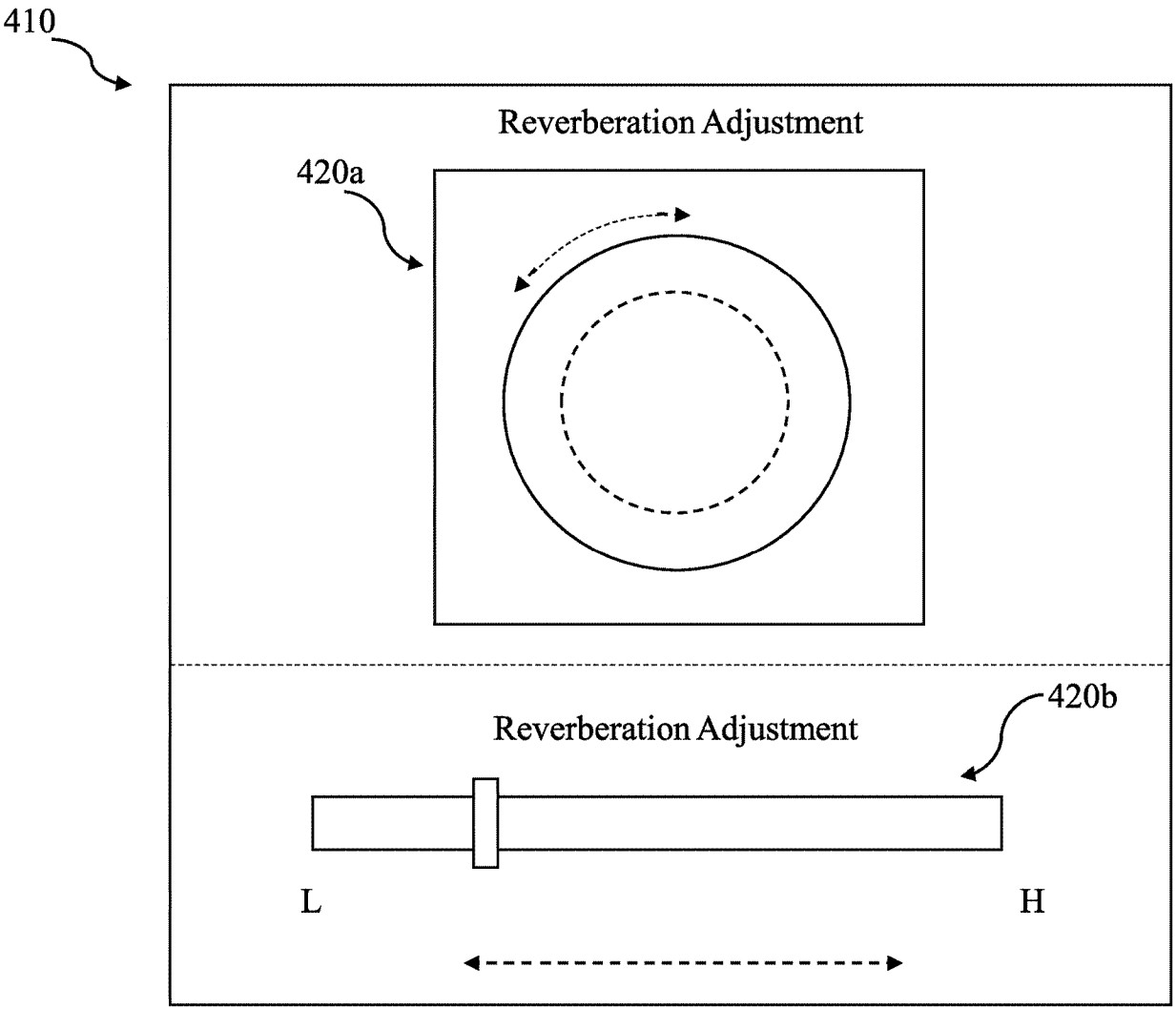
FIG. 4 shows an example user interface for controlling audio output in the audio system of FIGS. 1-3, according to various implementations.

While the audio systems (e.g., audio systems 100, 200, and 300) disclosed according to various implementations can be configured to detect uncorrelated information and control reverberant content presentation, these audio systems can also be configured to permit user selection and/or control of reverberant content. FIG. 4 shows an example interface 410, which can be integrated into and/or connected with the head unit 102 and/or the amplifier 114 (FIG. 1) and permit a user (such as listener 130*a-d*) to modify aspects of the audio content presentation. For example, the interface 410 can permit a user to select between reverberation settings, or to disable reverberation in the presentation of audio content. Interface 410 is shown including at least one interface command control 420 for modifying an aspect of the presented audio content, e.g., the reverberant content. Two example interface command controls 420*a*, 420*b* are shown in FIG. 4. Interface command control 420*a* shows a dial or knob configuration permitting adjustment of reverberation settings, e.g., across a spectrum of settings or between a pre-defined number of settings (such as notches). Interface command control 420*b* shows a slider control for adjusting reverberation settings, e.g., across a spectrum such as low (L) to high (H) or between the pre-defined number of settings. It is understood that any interface command control 420, such as the dial/knob 420*a* and the slider 420*b* can be physical components (e.g., three-dimensional objects) or touch-screen displays representing such components. The interface command controls 420, regardless of their display mechanism, can be actuatable to send control value commands to the amplifier 114 (FIG. 1) to modify the level of reverberation applied to the entertainment audio signals 110 to produce the reverberant signals 118.

In some cases, interface command controls 420 can include a touch-screen, one or more actuatable buttons or knobs, a motion sensor, voice sensor (microphone) or any other interface control capable of receiving commands from a user. While in some cases the interface 410 is located in the automobile, such as an integrated interface within other audio control functions presented to the users, in other cases, the interface 410 can be accessible via a connected device such as a smart device, or via one or more voice, gesture and/or tactile commands. In additional implementations, the interface 410 can include a touch screen with an icon that can be dragged, double-tapped, held, twisted (left or right) or otherwise manipulated to adjust the reverberation in the audio signal. In certain implementations, the amplifier 104 (FIG. 1) is configured to receive commands via interface 410, either directly or from a network connected device such as a remote control, smartphone, tablet, wearable electronic device, voice-controlled command system, etc., and may communicate over any network connection (e.g., cloud-based or distributed computing system).

A number of implementations have been described. Nevertheless, it will be understood that additional modifications may be made without departing from the scope of the inventive concepts described herein, and, accordingly, other embodiments are within the scope of the following claims. In the examples described above with respect to FIGS. 1-3, the reverberant content is generated artificially by applying a reverberation signal processing algorithm to the entertainment audio signal 110. In other implementations, as noted herein, the reverberant content is extracted from the entertainment audio signal 110 and may be processed and/or enhanced prior to being provided to the exciters for output.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

Additionally, actions associated with implementing all or part of the functions described herein can be performed by one or more networked computing devices. Networked computing devices can be connected over a network, e.g., one or more wired and/or wireless networks such as a local area network (LAN), wide area network (WAN), personal area network (PAN), Internet-connected devices and/or networks and/or a cloud-based computing (e.g., cloud-based servers).

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

I claim:

1. An audio system for a vehicle, the audio system comprising:

a plurality of speakers located in the vehicle;

at least one transducer affixed to an overhead structure of the vehicle, wherein the overhead structure comprises a headliner of the vehicle, and wherein the plurality of speakers are located in regions of the vehicle other than the headliner; and an amplifier connected with the plurality of speakers and the at least one transducer, the amplifier comprising circuitry configured to process entertainment audio signals to generate spatially enhanced entertainment audio content that is provided to the plurality of speakers for output, and reverberant content that is provided to the at least one transducer for output, wherein presentation of both the spatially enhanced entertainment audio content and the reverberant content within a cabin of the vehicle causes an occupant of the vehicle to have a first auditory perception of a size of the cabin, while presentation of only the spatially enhanced entertainment audio content within the cabin causes the occupant to have a second, different auditory perception of the size of the cabin, wherein the reverberant content is only provided to the at least one transducer affixed to the headliner of the vehicle, and wherein the first auditory perception of the size of the cabin is larger than the second auditory perception of the size of the cabin, wherein the reverberant content is only provided to the at least one transducer affixed to the headliner of the vehicle to simulate a time domain response and a frequency domain response of a small room having a short reverberation time, wherein the short reverberation time is less than or equal to two seconds.

2. The system of claim 1, wherein the at least one transducer comprises an exciter.

3. The system of claim 1, wherein the at least one transducer comprises a speaker distinct from the plurality of speakers.

4. The system of claim 1, wherein the circuitry in the amplifier comprises first circuitry for applying spatial enhancement processing to the entertainment audio signals to generate the spatially enhanced entertainment audio content.

5. The system of claim 4, wherein the circuitry further comprises second circuitry for applying reverberant signal processing to the entertainment audio signals to generate the reverberant content.

6. The system of claim 1, wherein the at least one transducer is affixed to the overhead structure of the vehicle at a location behind a front seat of the vehicle.

7. The system of claim 1, wherein the at least one transducer comprises a plurality of transducers configured to operate as a unit.

8. The system of claim 1, wherein the at least one transducer comprises a first transducer affixed to the overhead structure at a location directly above or in front of a front seat of the vehicle, and a second transducer affixed to the overhead structure at a location behind the front seat of the vehicle.

9. The system of claim 8, wherein the circuitry is further configured to apply a first gain to a reverb signal provided to the first transducer and apply a second gain to a reverb signal provided to the second transducer, wherein the second gain is equal to or greater than the first gain.

10. The system of claim 9, wherein the second transducer is one of a plurality of transducers configured to operate as a unit.

11. The system of claim 1, wherein the small room has physical dimensions that are larger than physical dimensions of the cabin of the vehicle.

12. The system of claim 1, further comprising:

a user interface connected with the amplifier, the user interface comprising a plurality of user-selectable settings for controlling the first auditory perception of the size of the cabin.

13. The system of claim 1, wherein the amplifier is further configured to:

detect uncorrelated information in the entertainment audio signals; and in response to failing to detect any uncorrelated information in the entertainment audio signals, disabling the generating of the reverberant content provided to the at least one transducer for output.

14. A computer-implemented method of controlling an audio system in a vehicle, the audio system comprising: a plurality of speakers located in the vehicle; at least one transducer affixed to an overhead structure of the vehicle, wherein the overhead structure comprises a headliner of the vehicle, and wherein the plurality of speakers are located in regions of the vehicle other than the headliner; and an amplifier connected with the plurality of speakers and the at least one transducer, the method comprising:

receiving entertainment audio signals from an external source; and from the entertainment audio signals, generating spatially enhanced entertainment audio content for output at the plurality of speakers, and generating reverberant content for output at the at least one transducer affixed to the headliner of the vehicle, wherein presentation of both the spatially enhanced entertainment audio content and the reverberant content within a cabin of the vehicle causes an occupant of the vehicle to have a first auditory perception of a size of the cabin while presentation of only the spatially enhanced entertainment audio content within the cabin causes the occupant to have a second, different auditory perception of the size of the cabin, wherein the reverberant content is only provided to the at least one transducer affixed to the headliner of the vehicle, wherein the first auditory perception of the size of the cabin is larger than the second auditory perception of the size of the cabin, wherein providing the reverberant content to only the at least one transducer affixed to the headliner of the vehicle simulates a time domain response and a frequency domain response of a small room having a short reverberation time, wherein the short reverberation time is less than or equal to two seconds.

* * * * *